US011371359B2

(12) United States Patent
Lecuyer et al.

(10) Patent No.: US 11,371,359 B2
(45) Date of Patent: Jun. 28, 2022

(54) TURBINE BLADE FOR A GAS TURBINE ENGINE

(71) Applicant: PRATT & WHITNEY CANADA CORP., Longueuil (CA)

(72) Inventors: Daniel Lecuyer, St-Bruno (CA); Othmane Leghzaouni, Brossard (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/105,583

(22) Filed: Nov. 26, 2020

(65) Prior Publication Data

US 2022/0162948 A1 May 26, 2022

(51) Int. Cl.
*F01D 5/18* (2006.01)
*F01D 5/14* (2006.01)

(52) U.S. Cl.
CPC ..... *F01D 5/18* (2013.01); *F01D 5/147* (2013.01); *F05D 2240/301* (2013.01); *F05D 2240/305* (2013.01); *F05D 2240/307* (2013.01); *F05D 2260/20* (2013.01)

(58) Field of Classification Search
CPC . F01D 5/20; F01D 5/141; F01D 5/147; F01D 5/18; F01D 5/186; F01D 5/187; F05D 2220/32; F05D 2260/20; F05D 2260/202; F05D 2240/301; F05D 2240/305; F05D 2240/307
See application file for complete search history.

(56) References Cited

U.S. PATENT DOCUMENTS

| | | | |
|---|---|---|---|
| 3,635,585 | A | 1/1972 | Metzler, Jr. |
| 3,781,129 | A | 12/1973 | Aspinwall |
| 4,010,531 | A | 3/1977 | Andersen |
| 4,142,824 | A | 3/1979 | Andersen |
| 4,390,320 | A | 6/1983 | Eiswerth |
| 4,411,597 | A | 10/1983 | Koffel |
| 4,424,001 | A | 1/1984 | North |
| 4,606,701 | A | 8/1986 | McClay |
| 4,893,987 | A | 1/1990 | Lee |
| 5,120,192 | A | 6/1992 | Ohtomo et al. |
| 5,660,523 | A | 8/1997 | Lee |

(Continued)

FOREIGN PATENT DOCUMENTS

| | | |
|---|---|---|
| CN | 102128055 | 7/2011 |
| CN | 207048823 | 2/2018 |

(Continued)

*Primary Examiner* — Eric J Zamora Alvarez
(74) *Attorney, Agent, or Firm* — Norton Rose Fulbright Canada LLP

(57) ABSTRACT

A turbine blade for a gas turbine engine has: an airfoil extending along a span from a base to a tip and along a chord from a leading edge to a trailing edge, the airfoil having a pressure side and a suction side, a tip pocket at the tip of the airfoil, the tip pocket at least partially surrounded by a peripheral tip wall defining a portion of the pressure and suction sides; at least one internal cooling passage in the airfoil and having at least one outlet communicating with the tip pocket; and a reinforcing bump located on the pressure side of the airfoil and protruding from a baseline surface of the peripheral tip wall to a bump end located into the tip pocket, the reinforcing bump overlapping a location where a curvature of a concave portion of the pressure side of the airfoil is maximal.

20 Claims, 4 Drawing Sheets

(56) References Cited

U.S. PATENT DOCUMENTS

| | | | |
|---|---|---|---|
| 5,733,102 | A | 3/1998 | Lee |
| 6,039,531 | A | 3/2000 | Suenaga |
| 6,059,530 | A | 5/2000 | Lee |
| 6,086,328 | A | 7/2000 | Lee |
| 6,164,914 | A | 12/2000 | Correia |
| 6,224,336 | B1 | 5/2001 | Kercher |
| 6,527,514 | B2 | 3/2003 | Roeloffs |
| 6,554,575 | B2 | 4/2003 | Leeke et al. |
| 6,595,749 | B2 | 7/2003 | Lee |
| 6,652,235 | B1 | 11/2003 | Keith |
| 6,672,829 | B1 | 1/2004 | Cherry |
| 6,790,005 | B2 | 9/2004 | Lee |
| 6,970,005 | B2 | 11/2005 | Rincon et al. |
| 7,258,528 | B2 | 8/2007 | Trindade et al. |
| 7,458,780 | B2 | 12/2008 | Weisse et al. |
| 7,473,073 | B1 | 1/2009 | Liang |
| 7,513,743 | B2 | 4/2009 | Liang |
| 7,704,045 | B1 | 4/2010 | Liang |
| 7,704,047 | B2 | 4/2010 | Liang et al. |
| 7,845,905 | B2 | 12/2010 | Ahmad et al. |
| 7,875,908 | B2 | 1/2011 | Adam et al. |
| 7,922,451 | B1 | 4/2011 | Liang |
| 7,967,563 | B1 | 6/2011 | Liang |
| 7,997,865 | B1 | 8/2011 | Liang |
| 8,011,889 | B1 | 9/2011 | Liang |
| 8,043,058 | B1 | 10/2011 | Liang |
| 8,047,789 | B1 | 11/2011 | Liang |
| 8,061,987 | B1 | 11/2011 | Liang |
| 8,083,484 | B2 | 12/2011 | Hatman |
| 8,096,768 | B1 | 1/2012 | Liang |
| 8,113,779 | B1 | 2/2012 | Liang |
| 8,157,504 | B2 | 4/2012 | Amaral |
| 8,231,349 | B2 | 7/2012 | Naik et al. |
| 8,251,660 | B1 | 8/2012 | Liang |
| 8,337,158 | B1 | 12/2012 | Liang |
| 8,435,004 | B1 | 5/2013 | Liang |
| 8,439,643 | B2 | 5/2013 | Kuhne |
| 8,469,666 | B1 | 6/2013 | Liang |
| 8,632,311 | B2 | 1/2014 | Klasing |
| 8,647,071 | B2 | 2/2014 | Pons et al. |
| 8,740,567 | B2 | 6/2014 | Suciu et al. |
| 8,777,572 | B2 | 7/2014 | Cheong |
| 8,801,379 | B2 | 8/2014 | Allen et al. |
| 9,057,276 | B2 | 6/2015 | Lee |
| 9,115,590 | B2 | 8/2015 | Spangler et al. |
| 9,120,144 | B2 | 9/2015 | Lee |
| 9,188,012 | B2 | 11/2015 | Lacy et al. |
| 9,297,262 | B2 | 3/2016 | Zhang et al. |
| 9,334,742 | B2 | 5/2016 | Zhang et al. |
| 9,593,584 | B2 | 3/2017 | Lehmann |
| 9,670,936 | B2 | 6/2017 | Cortequisse |
| 9,726,024 | B2 | 8/2017 | Buhler et al. |
| 9,810,074 | B2 | 11/2017 | Lee et al. |
| 9,856,739 | B2 | 1/2018 | Bedrosyan |
| 9,863,254 | B2 | 1/2018 | Ceglio et al. |
| 9,896,943 | B2 | 2/2018 | Crosatti et al. |
| 9,951,642 | B2 | 4/2018 | Bogue |
| 9,995,148 | B2 | 6/2018 | Molter et al. |
| 10,012,089 | B2 | 7/2018 | Quach |
| 10,053,989 | B2 | 8/2018 | Weber et al. |
| 10,077,680 | B2 | 9/2018 | Thibodeau et al. |
| 10,107,108 | B2 | 10/2018 | Jones |
| 10,174,620 | B2 | 1/2019 | Krumanaker et al. |
| 10,184,342 | B2 | 1/2019 | Zhang et al. |
| 10,190,418 | B2 | 1/2019 | Kwon |
| 10,253,637 | B2 | 4/2019 | Schroeder |
| 10,287,900 | B2 | 5/2019 | Slavens et al. |
| 10,301,943 | B2 | 5/2019 | Brittingham |
| 10,301,945 | B2 | 5/2019 | Chouhan et al. |
| 10,350,684 | B2 | 7/2019 | Bunker |
| 10,487,664 | B2 | 11/2019 | Bunker |
| 10,677,066 | B2 | 6/2020 | Lewis |
| 2002/0094268 | A1 | 7/2002 | Sugishita |
| 2002/0119045 | A1 | 8/2002 | Starkweather |
| 2003/0021684 | A1 | 1/2003 | Downs |
| 2003/0059304 | A1 | 3/2003 | Leeke |
| 2003/0170120 | A1 | 9/2003 | Grunke |
| 2004/0126236 | A1 | 7/2004 | Lee |
| 2005/0244270 | A1 | 11/2005 | Liang |
| 2006/0062671 | A1 | 3/2006 | Lee |
| 2006/0171809 | A1 | 8/2006 | Albrecht |
| 2008/0044289 | A1 | 2/2008 | Klasing |
| 2008/0044290 | A1 | 2/2008 | Klasing |
| 2010/0111704 | A1 | 5/2010 | Hada |
| 2010/0221122 | A1 | 9/2010 | Klasing |
| 2010/0232979 | A1 | 9/2010 | Paauwe |
| 2010/0316486 | A1* | 12/2010 | Townes ..... F01D 5/225 415/115 |
| 2011/0044818 | A1 | 2/2011 | Kuhne |
| 2013/0039773 | A1 | 2/2013 | Funk |
| 2013/0266454 | A1 | 10/2013 | Mongillo |
| 2014/0030101 | A1 | 1/2014 | Mishra |
| 2014/0030102 | A1 | 1/2014 | Mishra |
| 2014/0047842 | A1 | 2/2014 | Chlus |
| 2015/0330228 | A1 | 11/2015 | Quach |
| 2016/0052621 | A1 | 2/2016 | Ireland |
| 2016/0208621 | A1 | 7/2016 | Spangler et al. |
| 2016/0341046 | A1 | 11/2016 | Feldmann |
| 2016/0369634 | A1 | 12/2016 | Slavens et al. |
| 2017/0089207 | A1 | 3/2017 | Marsh et al. |
| 2017/0107825 | A1 | 4/2017 | Krumanaker et al. |
| 2017/0145833 | A1 | 5/2017 | Thornton |
| 2017/0167275 | A1 | 6/2017 | Schroeder |
| 2017/0226868 | A1 | 8/2017 | Martinello et al. |
| 2017/0335691 | A1 | 11/2017 | Crites |
| 2018/0066524 | A1 | 3/2018 | LoRicco et al. |
| 2018/0156042 | A1 | 6/2018 | Mongillo, Jr. et al. |
| 2018/0156049 | A1 | 6/2018 | Clum et al. |
| 2018/0202295 | A1 | 7/2018 | Rhodes et al. |
| 2018/0274373 | A1 | 9/2018 | Quach et al. |
| 2019/0136699 | A1 | 5/2019 | Spangler et al. |
| 2019/0169999 | A1 | 6/2019 | Rathay et al. |
| 2019/0186273 | A1 | 6/2019 | Halfmann |

FOREIGN PATENT DOCUMENTS

| | | |
|---|---|---|
| EP | 0340149 | 11/1989 |
| EP | 1362982 | 11/2003 |
| EP | 2666968 | 11/2013 |
| EP | 3042040 | 3/2019 |
| EP | 3460190 | 3/2019 |
| EP | 3498975 | 6/2019 |
| GB | 1188401 | 4/1970 |
| GB | 2382383 | 5/2003 |
| GB | 2402715 | 12/2004 |
| JP | 2008128247 | 6/2008 |
| WO | 0019065 | 4/2000 |
| WO | 2005068783 | 7/2005 |
| WO | 2005095761 | 10/2005 |
| WO | 2016076834 | 5/2016 |
| WO | WO2017/119898 A1 | 7/2017 |
| WO | 2018143997 | 8/2018 |

* cited by examiner

TURBINE BLADE FOR A GAS TURBINE ENGINE

TECHNICAL FIELD

The disclosure relates generally to gas turbine engines, and more particularly to blades used in turbine sections of such engines.

BACKGROUND OF THE ART

A turbine blade used in a gas turbine engine has a radially outward blade tip that rotates at high speed relative to a peripheral shroud defining a gaspath of the engine. Maintaining a minimal gap between the blade tip and the peripheral shroud is important to maintain efficiency.

A tip of an internally cooled turbine blade is cooled with cooling air exhausted through openings in the tip. The turbine blade tips are exposed to high gas temperature and mechanical forces imposed by the high rotation speed. Thermo-mechanical fatigue life of the airfoil and blade tips in particular can determine the repair cycle of an engine which may involve removal and replacement of turbine blades. Improvement is desirable to reduce the costs and delays involved with engine downtime caused by thermo-mechanical fatigue of turbine blade tips.

SUMMARY

In a first aspect, there is provided a turbine blade for a gas turbine engine, comprising: an airfoil extending along a span from a base to a tip and along a chord from a leading edge to a trailing edge, the airfoil having a pressure side and a suction side, a tip pocket at the tip of the airfoil, the tip pocket at least partially surrounded by a peripheral tip wall defining a portion of the pressure and suction sides; at least one internal cooling passage in the airfoil, the at least one internal cooling passage having at least one outlet communicating with the tip pocket; and a reinforcing bump located on the pressure side of the airfoil and protruding from a baseline surface of the peripheral tip wall to a bump end located into the tip pocket, the reinforcing bump overlapping a location where a curvature of a concave portion of the pressure side of the airfoil is maximal.

In some embodiments, a thickness of the peripheral tip wall at the reinforcing bump corresponds to a nominal thickness of the peripheral tip wall at a location adjacent the reinforcing bump plus a bump thickness of the reinforcing bump.

In some embodiments, the tip pocket is bounded by the peripheral tip wall and by a bottom wall, the bottom wall extending from the pressure side to the suction side, the bump extending from the bottom wall to the tip.

In some embodiments, a ratio of the thickness to the nominal thickness ranges from 1.5 to 2.5.

In some embodiments, the ratio of the thickness to the nominal thickness is about 1.75.

In some embodiments, a chordwise position of a center of the reinforcing bump is between chordwise positions of two outlets of the at least one outlet.

In some embodiments, a width of the reinforcing bump taken in a direction along the chord of the airfoil is about 10% of the chord of the airfoil.

In some embodiments, the reinforcing bump is located closer to the leading edge than to the trailing edge.

In some embodiments, a center of the reinforcing bump is located at 15% to 25% of the chord from the leading edge.

In some embodiments, the bump end is spaced apart from the suction side.

In some embodiments, the bump end of the reinforcing bump is closer to the baseline surface than to the suction side.

In another aspect, there is provided a turbine blade for a gas turbine engine, comprising an airfoil extending along a span from a base to a tip and along a chord from a leading edge to a trailing edge, the airfoil having a pressure side and a suction side, the tip of the airfoil defining a tip pocket surrounded by a peripheral tip wall defining a portion of the pressure and suction sides, the airfoil defining at least one internal cooling passage having outlets, at least one of the outlets communicating with the tip pocket, a section of the peripheral tip wall having a thickness defined from the pressure side to an end of the section, the thickness greater than a nominal thickness on opposite sides of the section, the end of the section located into the tip pocket, the section located at the pressure side of the airfoil and overlapping a location where a curvature of a concave portion of the pressure side of the airfoil is maximal.

In some embodiments, the tip pocket is bounded by the peripheral tip wall and by a bottom wall, the bottom wall extending from the pressure side to the suction side, the section extending from the bottom wall to the tip.

In some embodiments, a ratio of the thickness of the peripheral wall at the section to the nominal thickness ranges from 1.5 to 2.5.

In some embodiments, a chordwise position of a center of the section is between chordwise positions of two outlets of the at least one outlet.

In some embodiments, a width of the section taken in a direction along the chord of the airfoil is about 10% of the chord of the airfoil.

In yet another aspect, there is provided a gas turbine engine, comprising: a turbine section having a rotor, the rotor having a central hub and blades secured to the central hub and distributed about a central axis, each of the blades having an airfoil extending along a span from a base to a tip and along a chord from a leading edge to a trailing edge, the airfoil having a pressure side and a suction side, a tip pocket at the tip of the airfoil, the tip pocket at least partially surrounded by a peripheral tip wall defining a portion of the pressure and suction sides and extending from a bottom wall to the tip of the airfoil; at least one internal cooling passage in the airfoil, the at least one internal cooling passage hydraulically connected to a source of a cooling fluid and having outlets, at least one of the outlets communicating with the tip pocket; and a reinforcing bump located on the pressure side and locally increasing a thickness of the peripheral tip wall beyond a nominal thickness of the peripheral tip wall, the reinforcing bump ending into the tip pocket and distanced from the leading edge by about 15% of the chord or more.

In some embodiments, the turbine section includes a high-pressure turbine and a low-pressure turbine, the rotor being part of the high-pressure turbine, the rotor being a single rotor of the high-pressure turbine.

In some embodiments, the reinforcing bump overlaps a location where a curvature of a concave portion of the pressure side of the airfoil is maximal.

In some embodiments, a ratio of the thickness to the nominal thickness ranges from 1.5 to 2.5.

DESCRIPTION OF THE DRAWINGS

Reference is now made to the accompanying figures in which.

DETAILED DESCRIPTION

In at least some of the figures that follow, some elements appear more than once (e.g. there may be two, three, etc. of a given part in a given embodiment). Accordingly, only a first instance of each given element may be labeled, to maintain clarity of the figures.

Figure 1:
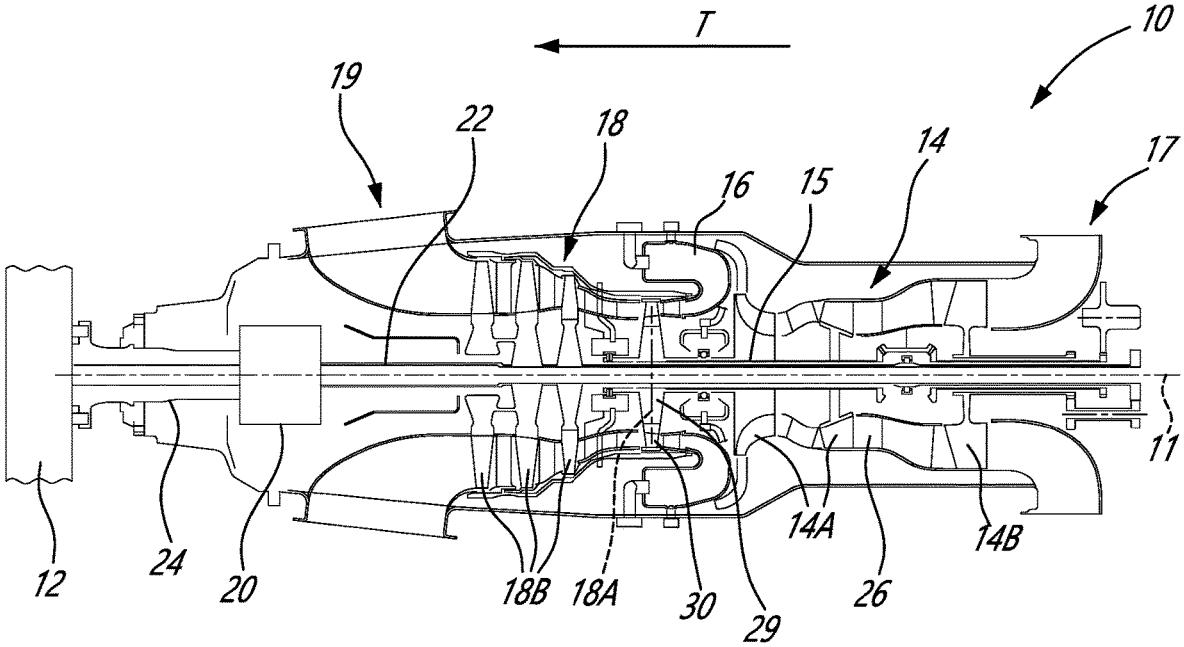
FIG. 1 is a schematic cross sectional view of a gas turbine engine.

FIG. 1 illustrates a gas turbine engine 10 of a type preferably provided for use in subsonic flight for driving a load 12, such as, but not limited to, a propeller or a helicopter rotor. Depending on the intended use, the engine 10 may be any suitable aircraft engine. In the present embodiment, the engine 10 is a gas turbine engine, and more particularly a turboprop, and generally comprises in serial flow communication a compressor section 14 for pressurizing the air, a combustor 16 in which the compressed air is mixed with fuel and ignited for generating an annular stream of hot combustion gases, and a turbine section 18 for extracting energy from the combustion gases.

The exemplary embodiment shown in FIG. 1 is a "reverse-flow" engine because gases flow within an annular gaspath 26 from an inlet 17, at a rear portion of the engine 10, to an exhaust outlet 19, at a front portion of the engine 10, relative to a direction of travel T of the engine 10. This is in contrast to "through-flow" gas turbine engines in which gases flow through the core of the engine 10 from a front portion to a rear portion, in a direction opposite the direction of travel T. The engine 10 may be a reverse-flow engine (as illustrated) or a through-flow engine. The principles of the present disclosure can be applied to both reverse-flow and through-flow engines and to any other gas turbine engines, such as a turbofan engine and a turboshaft engine.

In the illustrated embodiment, the turbine section 18 has a high-pressure turbine 18A in driving engagement with a high-pressure compressor 14A. The high-pressure turbine 18A and the high-pressure compressor 14A are mounted on a high-pressure shaft 15. The turbine 18 has a low-pressure turbine, also known as power turbine 18B drivingly engaged to the load 12. The power turbine 18B is drivingly engaged to a low-pressure compressor 14B via a low-pressure shaft 22. A gearbox 20, which may be a planetary gearbox, is configured as a reduction gearbox and operatively connects the low-pressure shaft 22 that is driven by the power turbine 18B to a shaft 24 that is in driving engagement with the load 12, while providing a reduction speed ratio therebetween. In the present embodiment, the load 12 is a rotor of an aircraft, and more particularly a propeller, and thus the shaft 24 driving the aircraft rotor is referred to as a rotor shaft.

It should be noted that the terms "upstream" and "downstream" used herein refer to the direction of an air/gas flow passing through the annular gaspath 26 of the gas turbine engine 10. It should also be noted that the term "axial", "radial", "angular" and "circumferential" are used with respect to a central axis 11 of the gaspath 26, which may also be a central axis of gas turbine engine 10. It should also be noted that expressions such as "extending radially" as used herein does not necessarily imply extending perfectly radially along a ray perfectly perpendicular to the central axis 11, but is intended to encompass a direction of extension that has a radial component relative to the central axis 11.

Figure 2:
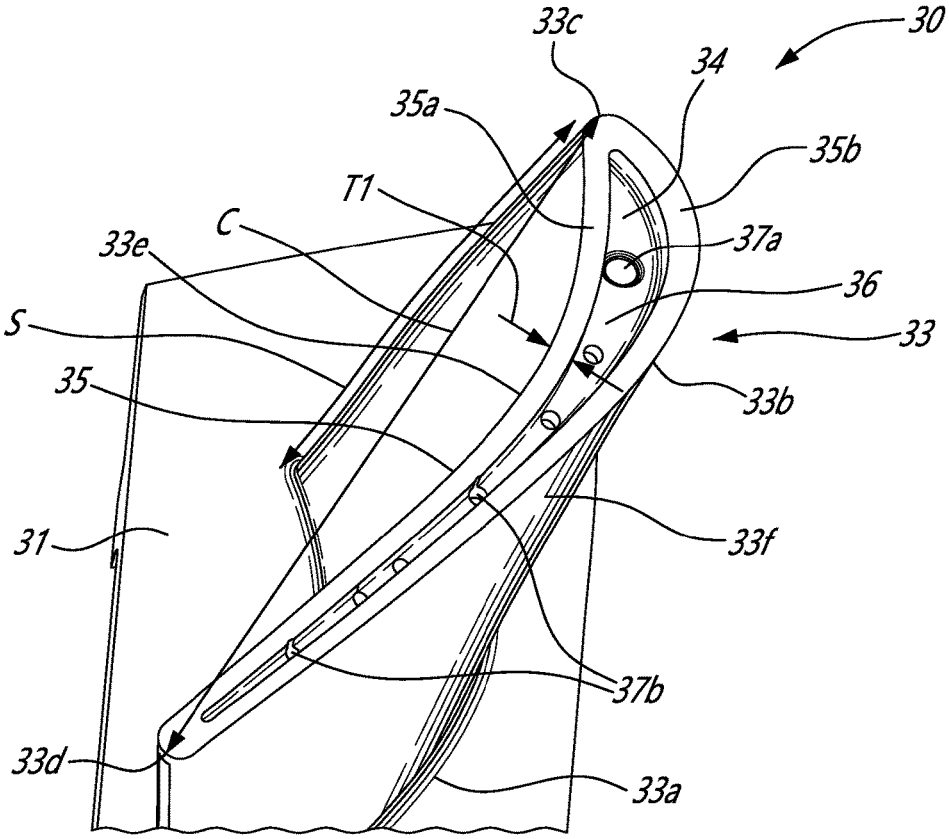
FIG. 2 is a top three dimensional view of a blade of a turbine section of the engine of FIG. 1 in accordance with one embodiment.

Referring to FIGS. 1-2, the high-pressure turbine 18*a* includes a rotor having a central hub 29 and a peripheral array of replaceable turbine blades 30. Any of the rotors of any of the high-pressure turbine 18*a* and the low-pressure turbine 18*b* may include blades as will be described herein below. In the embodiment shown, the disclosed turbine blades 30 are part of the high-pressure turbine 18*a*, which, in the present case, includes a single rotor.

Figure 3:
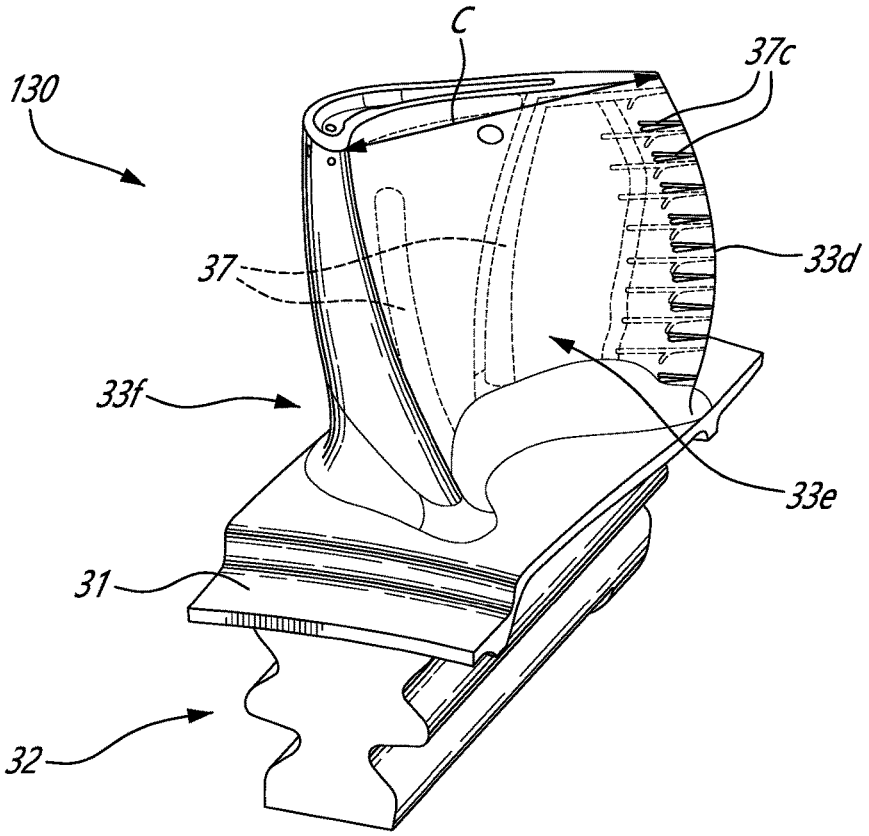
FIG. 3 is a three dimensional view of a blade of the turbine section of the engine of FIG. 1 in accordance with another embodiment.
Figure 4:
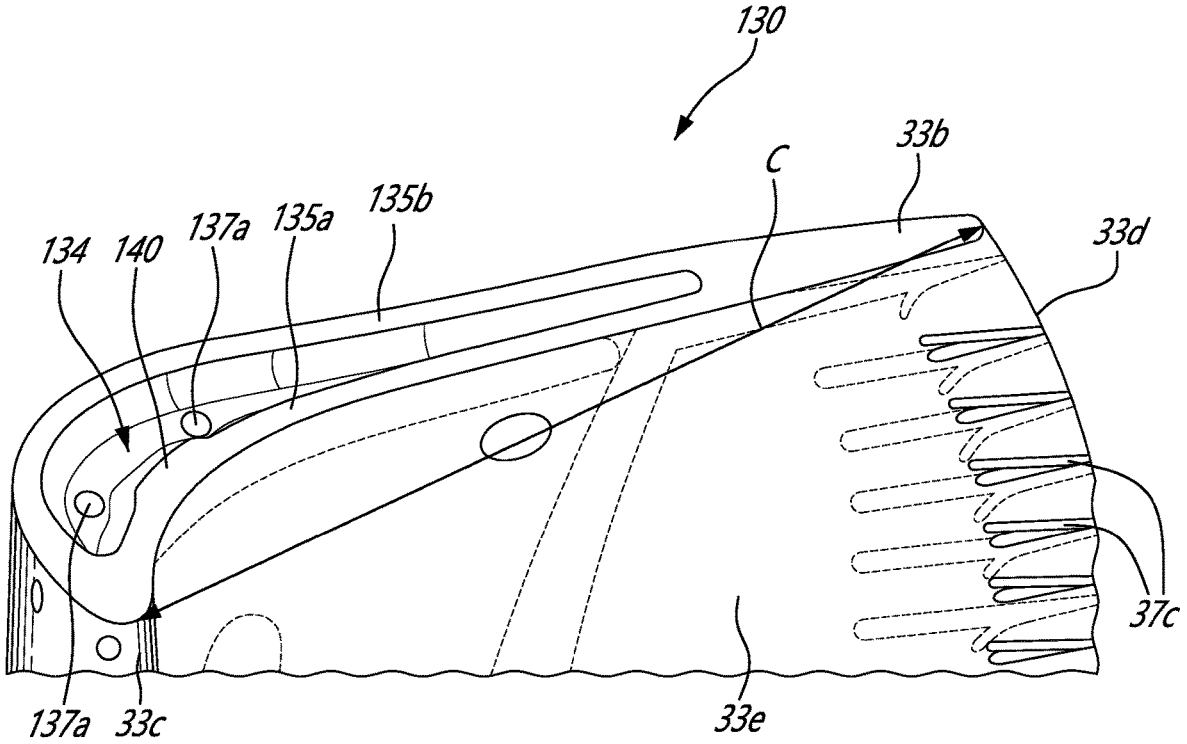
FIG. 4 is an enlarged view of a tip of the blade of FIG. 3.

Referring more particularly to FIG. 2, the blade 30 has a platform 31 exposed to the annular gaspath 26 and a root 32 (FIG. 3) protruding inwardly from the platform 31. The root 32 is received within correspondingly shaped slots defined by the central hub 29 (FIG. 1) to hold the blade 30 while the rotor is rotating about the central axis 11. The blade 30 has an airfoil 33 protruding from the platform 31 away from the root 32 along a span S. The airfoil 33 has a base 33*a* at the platform 31 and a tip 33*b* radially spaced apart from the root 33*a* relative to the central axis 11. The airfoil 33 hence extends along a direction having a radial component relative to the central axis 11 from the base 33*a* to the tip 33*b*. The airfoil 33 has a leading edge 33*c*, a trailing edge 33*d* spaced apart from the leading edge 33*c* by a chord C (FIG. 4), a pressure side 33*e* and a suction side 33*f* opposed to the pressure side 33*e*. The pressure and suction sides 33*e*, 33*f* extend from the leading edge 33*c* to the trailing edge 33*d* and from the base 33*a* to the tip 33*b*. The chord C is depicted here as a straight line connecting the leading edge 33*c* to the trailing edge 33*d*. The chord C may vary along the span S of the airfoil 33 between the base 33*a* and the tip 33*b*. The chord C differs from a camber line CL (FIG. 6), which corresponds to a line that may be curved and that connects the leading edge 33*c* to the trailing edge 33*d* and that is centered between the pressure and suctions sides 33*e*, 33*f*. In the present disclosure, when values are expressed in function of the chord (e.g., 10% of the chord C), the chord C is the one taken at a corresponding spanwise location (e.g., tip 33*b*) between the base 33*a* and the tip 33*b*.

The blade 30 has a tip pocket, also referred to as tip plenum, 34 circumscribed by a peripheral tip wall 35. The peripheral tip wall 35 defines a portion of the pressure side 33*e* and a portion of the section side 33*f*. The blade has an end wall which defines a bottom wall 36 of the tip plenum. The bottom wall 36 extends from the pressure side 33*e* to the suction side 33*f*. The tip pocket 34 is therefore substantially bounded by the peripheral tip wall 35 and the bottom wall 36. The blade 30 defines internal cooling passages 37 (only one cooling passage may be present) (FIG. 3) within the airfoil 33. The cooling passages 37 have tip outlets 37*a*, 37*b* communicating with the tip pocket 34 and side outlets 37*c* located between the base 33*a* and the tip 33*b* proximate the trailing edge 33*d* and through the pressure and/or suction sides 33*e*, 33*f*. The tip outlets 37*a*, 37*b* may differ by their diameter and, hence, by a mass flow rate of cooling air flowing therethrough. In the embodiment shown, the tip outlets 37*a*, 37*b* includes a first tip outlet 37*a* proximate the leading edge 33*c* of the airfoil 33 and a plurality of second tip outlets located between the first tip outlet 37*a* and the trailing edge 33*d*. The first and second tip outlets 37*a*, 37*b* are distributed along a camber line of the airfoil between the leading edge 33*c* and the trailing edge 33*d*. Diameters of the second tip outlets 37*b* decrease from the leading edge 33*c* to the trailing edge 33*d* because of a distance between the pressure and suction sides 33*e*, 33*f* decreases toward the trailing edge 33*d*. They may have a constant diameter. A density of the second tip outlets 37*b* may increase toward the trailing edge 33*d* to compensate for their smaller diameter. The cooling air may come from the compressor section 14 (FIG. 1) of the gas turbine engine 10. Many factors are involved in determining the position and size of the tip outlets: pressure distribution between the inside of the blade and the outside, the flow structure (orientation, etc) inside the blade, etc.

In use, the rotor of the high-pressure turbine 18*a* of the turbine section 18 rotates at high speed about the central axis 11. The pressure of the combustion gases at the pressure side 33*e* of the airfoil 33 is greater than that at the suction side 33*f* of the airfoil 33. This tends to induce a phenomenon known as "tip leakage" where the combustion gases tend to flow from the pressure side 33*e* to the suction side 33*f* of the airfoil 33 around the tip 33*b*. This may impair efficiency of the turbine section 18 because the turbine section 18 is not able to extract as much energy from the combustion gases as it could if no tip leakage were present. To deter the combustion gases to flow around the tip 33*b* of the airfoil 33, the peripheral tip wall 35 is created. That is, the peripheral tip wall 35 has a pressure side portion 35*a* and a suction side portion 35*b* spaced apart from the pressure side portion 35*a* by the pocket 34. The pressure and suction sides portions 35*a*, 35*b* of the peripheral tip wall 35 act as knife edges of a labyrinth seal and contributes in decreasing an amount of the combustion gases that flows within a gap between the tip 33*b* of the airfoil 33 and turbine shrouds circumferentially distributed around the blades 30 compared to a configuration in which the tip pocket 34 is absent. In other words, implementing the tip pocket 34 creates two knife edges, which corresponds here as the pressure and suction sides portions 35*a*, 35*b* of the peripheral tip wall 35. These side portions 35*a*, 35*b* of the peripheral tip wall 35 create a sealing engagement with the surrounding turbine shrouds. An amount of the combustion gases flowing from the pressure side 33*e* to the suction side 33*f* around the tip 33*b* may therefore be decreased by the implementation of the peripheral tip wall 35 and tip pocket 34 for a constant tip clearance.

However, a thickness T1 of the peripheral tip wall 35 may be quite small. In the embodiment shown, the thickness T1 is about 0.02 inch. Some locations of the peripheral tip wall 35 are simultaneously exposed to the hot combustion gases flowing through the turbine section 18 and to the cooler cooling air from the internal cooling passages 37 and exiting into the tip pocket 34. Hence, some locations of the peripheral tip wall 35 are subjected to strong temperature gradients. With time, these strong temperature gradients may expose the blade 30 to thermal mechanical fatigue (TMF) and may shorten the lifespan of the blades 30. Frequency of costly downtimes required to replace the blades 30 may therefore be increased. This may be undesired.

Moreover, if the blade 30 is used into the high-pressure turbine 18*a* of the turbine section 18, it will be exposed to the hottest temperatures since the high-pressure turbine 18*a* is immediately downstream of the combustor 16. In the embodiment shown, the high-pressure turbine 18*a* includes only a single rotor. Hence, the amount of work extracted from the combustion gases by the single rotor of the high-pressure turbine 18*a* is very high and, consequently, so are the temperature gradients the blades 30 of this single rotor are exposed to. This may enhance the TMF phenomenon described above.

The inventors of the present application noticed that some locations on the peripheral tip wall 35 may be more susceptible than other to TMF. For instance, an area on the pressure side portions 35*a* of the peripheral tip wall 35 is located where high thermal flux are present. The suction side portion 35*b* of the peripheral tip wall 35 may be seen as being shielded. Moreover, it has been further observed by the inventors of the present application that portions of the peripheral tip wall 35 that are closest to the first and second tip outlet 37*a*, 37*b* of the cooling passages 37 are more prone to high temperature gradients because the cooling air flowing within the pocket 34 is the coldest near the first and second tip outlets 37*a*, 37*b* defined through the bottom wall 36. Moreover, the inventors of the present application observed that a location of the peripheral tip wall 35 aligned with a location L1 (FIG. 5) where a curvature of a concave portion of the pressure side 33*e* of the airfoil 33 is maximal may be more prone to TMF. More specifically, TMF and curvature are related to other blade mechanical stresses from rotational forces that may create bending, and global thermal effects. These stresses and thermal effects may be amplified by the higher curvature of the airfoil. This stress component may be a driver for TMF.

Referring to FIGS. 3-6, a blade in accordance with another embodiment is shown at 130. The blade 130 may be used as part of the high-pressure turbine 18*a* of the turbine section 18 of the engine 10. The blade 130 may be used in any of the rotors of the turbine section 18 of the engine 10. Features of the blade 130 that are described below may at least partially alleviate the aforementioned drawbacks.

The blade 130 has a tip pocket 134 bounded by a peripheral tip wall 135 and by a bottom wall 136. Outlets 137*a* of the cooling passages 37 are defined through the bottom wall 136 to supply the tip pocket 134 with cooling air. In order to decrease the thermal gradients discussed above, a reinforcing bump 140 is defined by the peripheral tip wall 135. The reinforcing bump 140 locally increases a thickness of the peripheral tip wall 135. In other words, the reinforcing bump 140 corresponds to a section of the peripheral tip wall 135 having a greater thickness than a nominal thickness of the peripheral tip wall 135 on opposite sides of the reinforcing bump 140. This increase in thickness may allow to increase stiffness of the peripheral tip wall 135 and may allow to decrease thermal gradients therein because of the added material.

Figure 5:
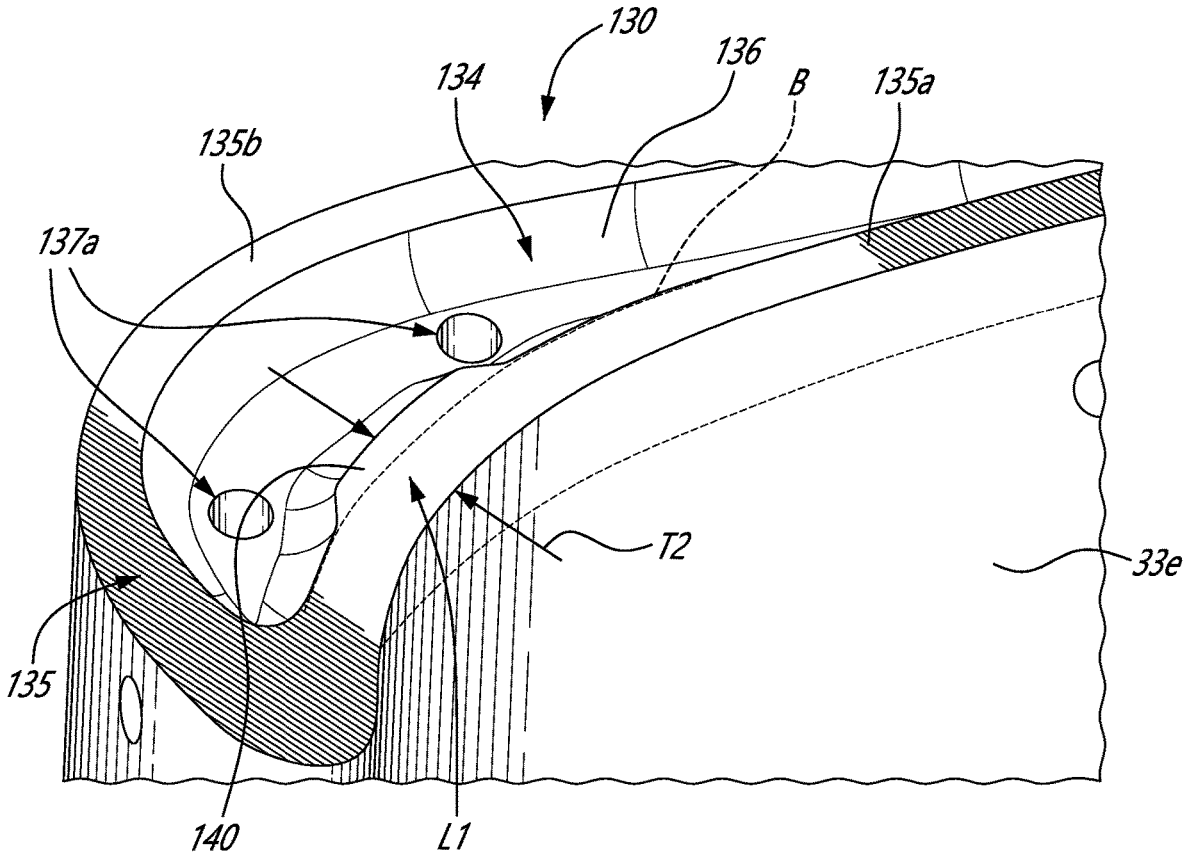
FIG. 5 is an enlarged view of a portion of FIG. 4.
Figure 6:
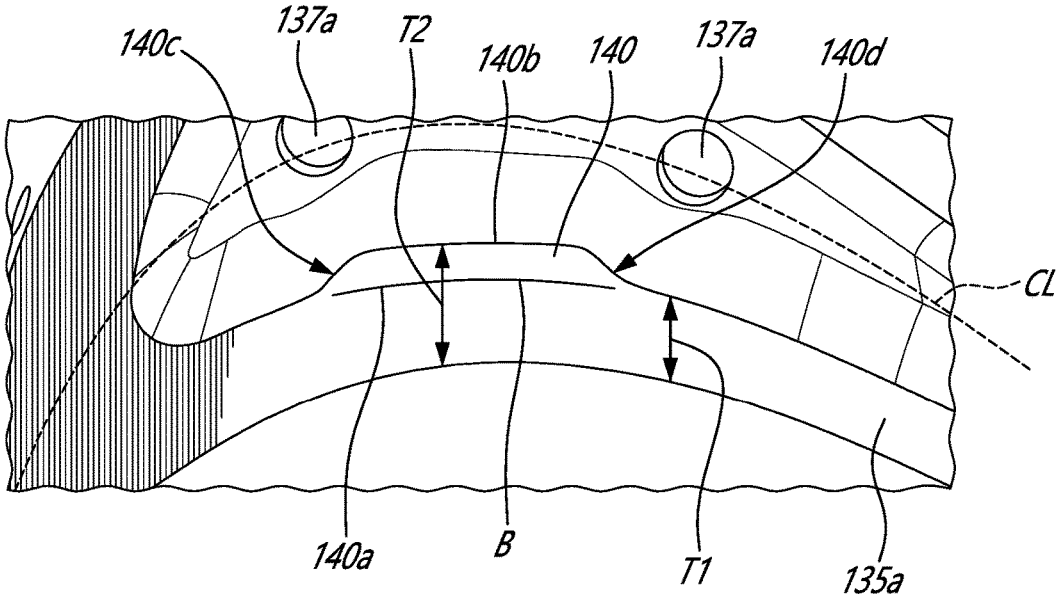
FIG. 6 is a top view showing a portion of a tip of the blade of FIG. 3.

In the illustrated embodiment, the reinforcing bump 140 extends from the pressure side portion 135*a* of the peripheral tip wall 135 into the pocket 134. The reinforcing bump 140 is located at the location L1 where high thermal flux are present on the blade 130 The location L1 is located on the pressure side 33*e* of the airfoil 33. As illustrated in FIG. 5, the reinforcing bump 140 is located between two first outlets 137*a* of the cooling passages 37. The two first outlets 137*a* are disposed linearly along the camber line CL of the airfoil 33. In the present embodiment, the two first outlets 137*a* are centered on the camber line CL. Diameters of the two first outlets 137*a* are substantially equal to one another. The two first outlets 137*a* are the first tip outlets of the blade 130 starting from the leading edge 33*c* toward the trailing edge 33*d*. Second tip outlets 37*c* (FIG. 2) are located between the first tip outlets 137*a* and the trailing edge 33*d*. As illustrated in FIG. 6, a chordwise position of a center of the reinforcing bump 140 is between chordwise positions of the first two tip outlets 137*a* starting from the leading edge 33*c*. In the depicted embodiment, the reinforcing bump 140 overlaps a location where a curvature of a concave portion of the pressure side 33*e* of the airfoil is maximal.

As illustrated in FIGS. 5-6, the reinforcing bump 140 protrudes from a baseline surface B of the pressure side portion 135*a* of the peripheral tip wall 135 from a bump root 140*a* to a bump end 140*b*. The reinforcing bump 140 may be made of a different material secured (i.e., welded) to the peripheral tip wall 35. The bump 140 may be made of a welded element of the same material as a remainder of the blade 130 or of another compatible alloy. In the present case, the reinforcing bump 140 monolithically protrudes from the baseline surface B of the peripheral tip wall 35. As shown in FIG. 6, the bump end 140*b* is spaced apart from the suction side portion 135*b* of the peripheral tip wall 135. That is, in the depicted embodiment, the reinforcing bump 140 does not extend fully across the tip pocket 134. In other words, the suction side 33*f* of the airfoil 33 is free from direct connection to the reinforcing bump 140.

Particularly, in the illustrated embodiment, the reinforcing bump 140 does not extend past the camber line CL of the airfoil 33 at the tip 33*b*. The two outlets 137*a* may be substantially centered between the pressure and suction sides 33*e*, 33*f* and may be aligned on the camber line CL. That is, the reinforcing bump 140 does not intersect an imaginary straight line connecting together the two outlets 137*a*.

In the embodiment shown, a center of the reinforcing bump 140 is located at 15% to 25% of the chord C from the leading edge 33*c*. A width of the bump 140 taken in a direction along the chord C from a fore end 140*c* to a rear end 140*d* is about 10% of the chord C. In the present case, the reinforcing bump 140 is located closer to the leading edge 33*c* than to the trailing edge 33*d*. The reinforcing bump 140 extends from the bottom wall 136 to the tip 33*b* of the airfoil 33. That is, a radial height of the reinforcing bump 140 is the same as that of the peripheral tip wall 135.

In the embodiment shown, the thickness T2 of the peripheral tip wall 135 at the reinforcing bump 140 is greater than the nominal thickness T1 of the peripheral tip wall 135. The nominal thickness T1 may correspond to the thickness of the peripheral tip wall 135 on opposite sides of the reinforcing bump 140. A ratio of the thickness T2 at the reinforcing bump 140 to the nominal thickness T1 ranges from about 1.5 to about 2.5. In the embodiment shown, the ratio of the thickness T2 at the reinforcing bump 140 to the nominal thickness T1 is 1.75. In the present case, the thickness T1 at the reinforcing bump 140 is about 0.035 inch.

In the present case, the reinforcing bump 140 includes solely one bump. That is, the blade 130 may be free from other reinforcing bumps. A thickness of the peripheral tip wall 135 may be substantially constant but for the reinforcing bump 140. In a particular embodiment, the tip wall thickness is 0.020 inch and may vary from 0.013 to 0.033 inch. However, the thickness of the wall at the baseline surface B on which the bump 140 is located may have a thickness of 0.02 inch plus or minus 0.003 inch. That is, the thickness of the wall at the baseline surface may range from 0.017 inch to 0.023 inch. The bump 140 may be 0.015 inch proud from the baseline surface B and may vary by plus or minus 0.006 inch. That is, from 0.009 inch to 0.021 inch. In a particular embodiment, a thickness of the bump 140 may vary along its length. That is, the bump 140 may be non uniform in thickness.

Figure 7:
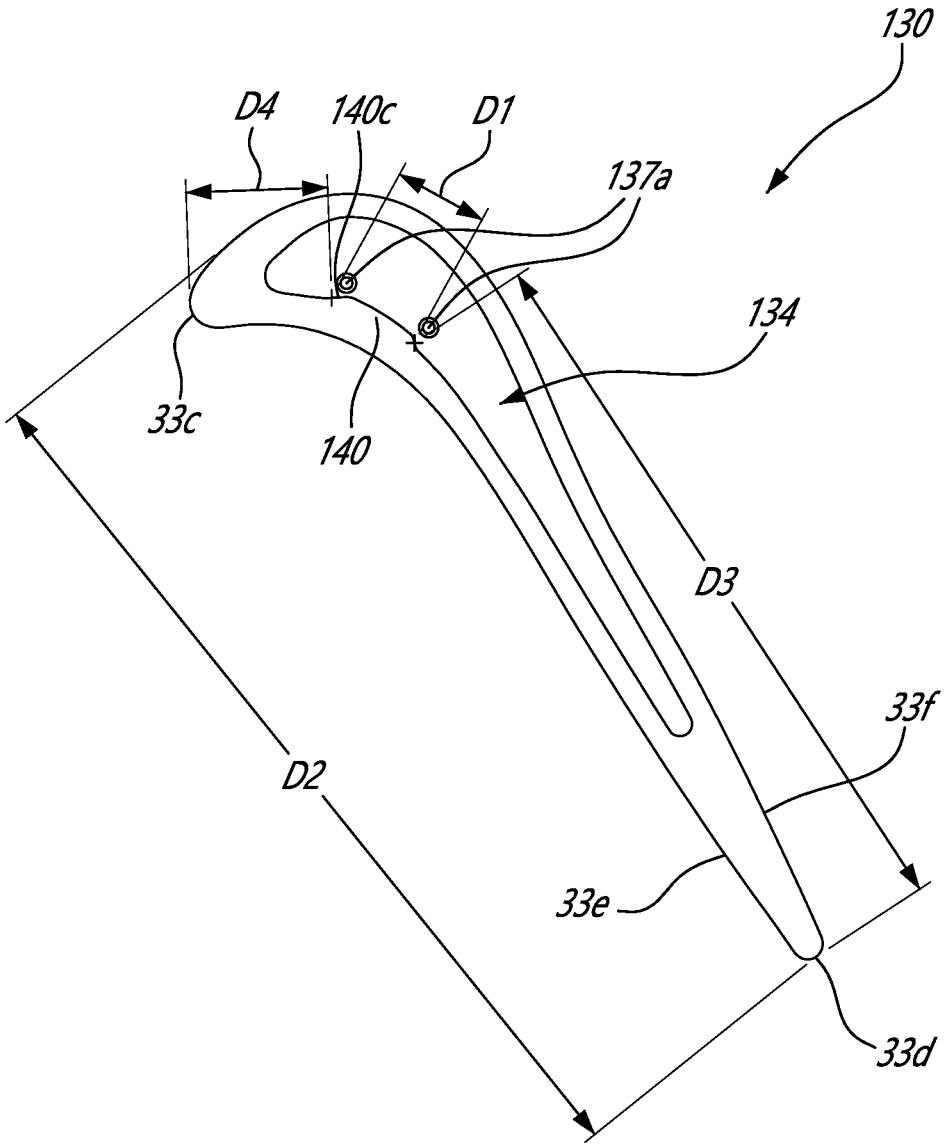
FIG. 7 is a top view of the tip of the blade of FIG. 3.

Referring now to FIG. 7, a ratio of a distance D1 between the first two tip outlets 137*a* to a distance D2 between a forward-most point of the tip of the blade 130 and the trailing edge 33*d* of the tip of the blade 130 may be about 0.10. A ratio of a distance D3 between a rearward-most one of the first two tip outlets 137*a* and the trailing edge 33*d* to the distance D2 between the forward-most point of the tip of the blade 130 and the trailing edge 33*d* is about 0.79. A ratio of a distance D4 between the fore end 140*c* of the bump 140 and the leading edge 33*c* to the distance D2 between the forward-most point of the tip of the blade 130 and the trailing edge 33*d* is about 0.15. Herein, "about" imply a variation of plus or minus 10%.

The durability of the blade 130 including the peripheral tip wall 135 may be increased by the reinforcing bump 140. The reinforcing bump 140, by protruding into the pocket 136, may avoid any change to the external airfoil geometry and with a negligible weight increase. Accordingly the thermo-mechanical fatigue life of the blade 130 may be addressed by addition of the reinforcing bump 140 in accordance with the example described above and shown in the drawings.

This present disclosure introduces a local thickening of the peripheral tip wall, which may reduce the thermal gradient and may reduce the nominal stress. This may lead to an improvement in TMF life at the location of the added thickness. Since the air inside the tip pocket 136 is a resultant of tip leakage and core cooling air exhausted through the outlets of the cooling passages, and because of thermal conductivity, the wall surface temperature on the tip pocket side is lower than the wall surface temperature on the pressure side of the blade. The combination of environmental stresses and the stress caused by the described thermal difference results in high local stresses at specific locations along this wall. The increased thickness may spread the temperature difference over a larger area, and may allow for better conduction of heat out of that area. This may reduce the gradient and improve the TMF life.

In the present disclosure, the expression "about" means that a value may vary by 10% of the value. For instance, about 10 implies that the value varies from 9 to 11.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A turbine blade for a gas turbine engine, comprising:

an airfoil extending along a span from a base to a tip and along a chord from a leading edge to a trailing edge, the airfoil having a pressure side and a suction side;

a tip pocket at the tip of the airfoil, the tip pocket at least partially surrounded by a peripheral tip wall defining a portion of the pressure and suction sides;

at least one internal cooling passage in the airfoil, the at least one internal cooling passage having at least one outlet communicating with the tip pocket; and a reinforcing bump located on the pressure side of the airfoil and protruding from a baseline surface of the peripheral tip wall to a bump end located into the tip pocket, the reinforcing bump overlapping a location where a curvature of a concave portion of the pressure side of the airfoil is maximal, the blade being free of other reinforcing bumps.

2. The turbine blade of claim 1, wherein a thickness of the peripheral tip wall of the reinforcing bump corresponds to a nominal thickness of the peripheral tip wall at a location adjacent the reinforcing bump plus a bump thickness of the reinforcing bump.

3. The turbine blade of claim 1, wherein the tip pocket is bounded by the peripheral tip wall and by a bottom wall, the bottom wall extending from the pressure side to the suction side, the bump extending from the bottom wall to the tip.

4. The turbine blade of claim 2, wherein a ratio of the thickness to the nominal thickness ranges from 1.5 to 2.5.

5. The turbine blade of claim 4, wherein the ratio of the thickness to the nominal thickness is about 1.75.

6. The turbine blade of claim 1, wherein a chordwise position of a center of the reinforcing bump is between chordwise positions of two outlets of the at least one outlet.

7. The turbine blade of claim 1, wherein a width of the reinforcing bump taken in a direction along the chord of the airfoil is about 10% of the chord of the airfoil.

8. The turbine blade of claim 1, wherein the reinforcing bump is located closer to the leading edge than to the trailing edge.

9. The turbine blade of claim 8, wherein a center of the reinforcing bump is located at 15% to 25% of the chord from the leading edge.

10. The turbine blade of claim 1, wherein the bump end is spaced apart from the suction side.

11. The turbine blade of claim 10, wherein the bump end of the reinforcing bump is closer to the baseline surface than to the suction side.

12. A turbine blade for a gas turbine engine, comprising an airfoil extending along a span from a base to a tip and along a chord from a leading edge to a trailing edge, the airfoil having a pressure side and a suction side, the tip of the airfoil defining a tip pocket surrounded by a peripheral tip wall defining a portion of the pressure and suction sides, the airfoil defining at least one internal cooling passage having outlets, at least one of the outlets communicating with the tip pocket, a section of the peripheral tip wall having a thickness defined from the pressure side to an end of the section, the thickness greater than a nominal thickness on adjacent sides of the section, the end of the section located into the tip pocket, the section located at the pressure side of the airfoil and overlapping a location where a curvature of a concave portion of the pressure side of the airfoil is maximal, the section having a fore end and a rear end, the fore end located forward of the location, the rear end located rearward of the location, the blade being free of other such sections.

13. The turbine blade of claim 12, wherein the tip pocket is bounded by the peripheral tip wall and by a bottom wall, the bottom wall extending from the pressure side to the suction side, the section extending from the bottom wall to the tip.

14. The turbine blade of claim 13, wherein a ratio of the thickness of the peripheral tip wall at the section to the nominal thickness ranges from 1.5 to 2.5.

15. The turbine blade of claim 14, wherein the at least one of the outlets includes two outlets, a chordwise position of a center of the section is between chordwise positions of the two outlets.

16. The turbine blade of claim 15, wherein a width of the section taken in a direction along the chord of the airfoil is about 10% of the chord of the airfoil.

17. A gas turbine engine, comprising:

a turbine section having a rotor, the rotor having a central hub and blades secured to the central hub and distributed about a central axis, each of the blades having an airfoil extending along a span from a base to a tip and along a chord from a leading edge to a trailing edge, the airfoil having a pressure side and a suction side, a tip pocket at the tip of the airfoil, the tip pocket at least partially surrounded by a peripheral tip wall defining a portion of the pressure and suction sides and extending from a bottom wall to the tip of the airfoil;

at least one internal cooling passage in the airfoil, the at least one internal cooling passage hydraulically connected to a source of a cooling fluid and having outlets, at least one of the outlets communicating with the tip pocket; and a reinforcing bump located on the pressure side and has a locally increased thickness of the peripheral tip wall beyond a nominal thickness of the peripheral tip wall, the reinforcing bump has an end extending into the tip pocket and distanced from the leading edge by about 15% of the chord or more, a thickness of the peripheral tip wall between the leading edge and the reinforcing bump corresponding to the nominal thickness, each blade being free of other reinforcing bumps.

18. The gas turbine engine of claim 17, wherein the turbine section includes a high-pressure turbine and a low-pressure turbine, wherein the rotor is part of the high-pressure turbine, and wherein the rotor is a single rotor of the high-pressure turbine.

19. The gas turbine engine of claim 18, wherein the reinforcing bump overlaps a location where a curvature of a concave portion of the pressure side of the airfoil is maximal.

20. The gas turbine engine of claim 19, wherein a ratio of the thickness to the nominal thickness ranges from 1.5 to 2.5.

* * * * *